US006813917B2

(12) United States Patent
Miller et al.

(10) Patent No.: US 6,813,917 B2
(45) Date of Patent: Nov. 9, 2004

(54) HIGH SECURITY LOCK MECHANISM

(75) Inventors: J. Clayton Miller, Nicholasville, KY (US); Michael Harvey, Newp. Bch., CA (US); James L. Taylor, Lex, KY (US); Thomas Clark, Lexington, KY (US); Gerry Dawson, Lex, KY (US)

(73) Assignee: C&M Technology, Inc., Nicholasville, KY (US)

( * ) Notice: Subject to any disclaimer, the term of this patent is extended or adjusted under 35 U.S.C. 154(b) by 0 days.

(21) Appl. No.: 10/391,830

(22) Filed: Mar. 19, 2003

(65) Prior Publication Data

US 2003/0172694 A1 Sep. 18, 2003

Related U.S. Application Data

(63) Continuation of application No. 09/985,975, filed on Nov. 7, 2001, now Pat. No. 6,546,769, which is a continuation of application No. 09/409,760, filed on Sep. 30, 1999, now Pat. No. 6,314,773, which is a continuation of application No. 08/985,901, filed on Dec. 5, 1997, now Pat. No. 5,960,655, which is a continuation of application No. 08/593,725, filed on Jan. 29, 1996, now Pat. No. 5,720,194, which is a division of application No. 08/371,319, filed on Jan. 11, 1995, now Pat. No. 5,487,290, which is a continuation of application No. 07/819,216, filed on Jan. 13, 1992, now abandoned.

(51) Int. Cl.[7] ..... E05B 49/02

(52) U.S. Cl. ..... 70/303 A; 70/278.1; 70/278.4; 70/278.6; 292/144

(58) Field of Search ..... 70/276, 277, 278.1–278.7, 70/283, 303 A; 292/142, 144, 201; 74/547; 341/35; 340/5.5

(56) References Cited

U.S. PATENT DOCUMENTS

| | | | | |
|---|---|---|---|---|
| 686,073 | A | 11/1901 | Hollar et al. | 70/278.6 |
| 2,399,906 | A | 5/1946 | Bentley | 74/527 |
| 3,024,452 | A | 3/1962 | Leonard | 340/274 |
| 3,097,327 | A | 7/1963 | Bloor et al. | 317/134 |
| 3,320,490 | A | 5/1967 | Beck et al. | 317/134 |

(List continued on next page.)

FOREIGN PATENT DOCUMENTS

| | | |
|---|---|---|
| DE | 1065871 | 9/1959 |
| DE | 0260860 A1 | 3/1988 |
| DE | 3817696 | 11/1989 |
| EP | 21670 | 1/1981 |
| EP | 0361881 | 4/1990 |
| FR | 1543004 | 10/1968 |
| GB | 2202577 | 9/1988 |
| WO | WO 80/02710 | 12/1980 |

OTHER PUBLICATIONS

*X.07: A Safe Lock That Operates Electronically*, 2342 Locksmith Ledger International, No. 9 (Jul. 1991).

*Primary Examiner*—Lloyd A. Gall
(74) *Attorney, Agent, or Firm*—Wood, Herron & Evans, L.L.P.

(57) ABSTRACT

A self-powered electric lock includes a lock bolt and a first engagement element having disengaged and engageable positions. An electric actuator includes an output operative to move the first engagement element to its engageable position. A manually operated rotatable member is operatively coupled to the first engagement element when the first engagement element is in its engageable position. A lock bolt drive mechanism is coupled to the lock bolt and to the first engagement element when the first engagement element is in its engageable position. The movable output moves the first engagement element to its engageable position upon input of correct electronic data. An electricity generator is coupled to the manually operated rotatable member. The electricity powers the electric actuator and an electronic data input device. The manually operated rotatable member is also used to actuate the lock bolt drive mechanism and retract the lock bolt.

5 Claims, 7 Drawing Sheets

U.S. PATENT DOCUMENTS

| | | | | |
|---|---|---|---|---|
| 3,468,143 | A | 9/1969 | Douglas et al. | |
| 3,633,167 | A | 1/1972 | Hedin | 340/825.32 |
| 3,718,764 | A | 2/1973 | Deschenes et al. | 179/2 |
| 3,733,861 | A | 5/1973 | Lester | 70/153 |
| 3,796,889 | A | 3/1974 | Fradkin et al. | 361/172 |
| 3,812,403 | A | 5/1974 | Gartner | 70/278 |
| 3,958,231 | A | 5/1976 | Hoffman | 340/274 C |
| 3,978,376 | A | 8/1976 | Wilson | 317/134 |
| 4,095,239 | A | 6/1978 | Gerry | 340/147 MD |
| 4,114,147 | A | 9/1978 | Hile | 340/528 |
| 4,232,354 | A | 11/1980 | Mueller et al. | 70/278 X |
| 4,379,245 | A | 4/1983 | Goldstein | 310/319 |
| 4,433,355 | A | 2/1984 | Chew et al. | 361/172 |
| 4,438,962 | A | 3/1984 | Soloviff et al. | 292/144 |
| 4,457,148 | A | 7/1984 | Johansson et al. | 70/278 |
| 4,502,048 | A | 2/1985 | Rehm | 340/825.31 |
| 4,625,848 | A | 12/1986 | Meyers et al. | 292/142 X |
| 4,631,940 | A | 12/1986 | Krivec et al. | 70/332 |
| 4,671,087 | A | 6/1987 | Olenfalk et al. | 70/283 |
| 4,684,945 | A | 8/1987 | Sanderford, Jr. | 340/825.56 |
| 4,745,784 | A | 5/1988 | Gartner | 70/278 X |
| 4,754,625 | A | 7/1988 | McGourty et al. | 70/278 X |
| 4,759,062 | A | 7/1988 | Traub et al. | 380/23 |
| 4,766,746 | A | 8/1988 | Henderson et al. | 70/63 |
| 4,832,385 | A | 5/1989 | Llort | 292/144 |
| 4,833,465 | A | 5/1989 | Abend et al. | 292/144 X |
| 4,912,460 | A | 3/1990 | Chu | 340/825.31 |
| 5,021,776 | A | 6/1991 | Anderson et al. | 340/825.31 |
| 5,061,923 | A | 10/1991 | Miller et al. | 340/825.31 |
| 5,265,452 | A | 11/1993 | Dawson et al. | 70/278 |
| 5,299,436 | A | 4/1994 | Spitzer | 70/58 |
| 5,307,656 | A | 5/1994 | Gartner et al. | 70/278 X |
| 5,487,290 | A | 1/1996 | Miller et al. | 70/303 A |
| 5,517,184 | A | 5/1996 | Dawson et al. | 340/825.31 |
| 5,647,235 | A | 7/1997 | Clark et al. | 70/278 |
| 5,653,135 | A | 8/1997 | Miller et al. | 70/303 A |
| 5,715,716 | A | 2/1998 | Miller et al. | 70/278 X |
| 5,720,194 | A | 2/1998 | Miller et al. | 70/303 A |
| 5,862,692 | A | 1/1999 | Legault et al. | 70/278 |
| 5,896,026 | A | 4/1999 | Higgins | 320/166 |
| 5,960,655 | A | 10/1999 | Miller et al. | 70/303 A |
| 6,034,616 | A | 3/2000 | Harvey et al. | 340/825.31 |
| 6,052,063 | A | 4/2000 | Miller et al. | 340/5.31 |
| 6,420,958 | B1 | 7/2002 | Miller et al. | 340/5.55 |
| 6,546,769 | B2 * | 4/2003 | Miller et al. | 70/303 A |

* cited by examiner

HIGH SECURITY LOCK MECHANISM

This application is a continuation of application Ser. No. 09/985,975 filed Nov. 7, 2001, U.S. Pat. No. 6,546,769 which is a continuation of application Ser. No: 09/409,760 filed Sep. 30, 1999 (now U.S. Pat. No. 6,314,773) which is a continuation of application Ser. No. 08/985,901 filed Dec. 5, 1997 (now U.S. Pat. No. 5,960,655) which is a continuation of application Ser. No. 08/593,725 filed Jan. 29, 1996 (now U.S. Pat. No. 5,720,194), which is a division of application Ser. No. 08/371,319 filed Jan. 11, 1995 (now U.S. Pat. No. 5,487,290), which is a continuation of application Ser. No. 07/819,216 filed Jan. 13, 1992 (abandoned).

The stringency of relevant U.S. government specifications is readily appreciated from Federal Specification FF-L2740, dated Oct. 12, 1989, titled "FEDERAL SPECIFICATION: LOCKS, COMBINATION" for the use of all federal agencies. Section 3.4.7, "Combination Redial", for example, requires that once the lock-bolt has been extended to its locked position "it shall not be possible to reopen the lock without completely redialing the locked combination", and defines the locked position as one in which the bolt has been fully extended. Section 3.6.1.3, "Emanation Analysis", requires that the lock shall not emit any sounds or other signals which may be used to surreptitiously open the lock within a specified period. Section 4.5.2.2.4, "Surreptitious Entry", requires that for any lock to be deemed acceptable, attempts shall be made to, unlock the lock through manipulation, radiological analysis and emanations analysis, further including the use of computer enhancement techniques for signals or emanations. Even further, Section 6.3.2 defines surreptitious entry as a method of entry such as manipulation or radiological attack which would not be detectable during normal use or during inspection by a qualified person.

TECHNICAL FIELD OF THE INVENTION

This invention relates to a high security lock mechanism and, more particularly, to an electronically controlled combination lock and lock-bolt operable by a very small amount of self-generated electrical power.

BACKGROUND OF THE PRIOR ART

Items of extremely sensitive nature or very high proprietary value often must be stored securely in a safe or other containment device, with access to the items restricted to selected individuals given a predetermined combination code necessary to enable authorized unlocking thereof. It is essential to ensure against unauthorized unlocking of such safe containers by persons employing conventional safe-cracking techniques or sophisticated equipment for applying electrical or magnetic fields, high mechanical forces, or accelerations intended to manipulate elements of the locking mechanism to thereby open it.

Numerous locking mechanisms are known which employ various combinations of mechanical, electrical and magnetic elements both to ensure against unauthorized operation and to effect cooperative movements among the elements for authorized locking and unlocking operations.

One example of such recently-developed devices is disclosed in U.S. Pat. No. 4,684,945, to Sanderford, Jr., which relates to an electronic lock actuated by a predetermined input through a keyboard outside a safe to a programmable control unit within a housing of the safe. The device has an electric motor for driving a lock-bolt for locking a safe door to the safe housing, and means for displaying codes entered by the user, with a facility for selectively changing the necessary code. The device also has a battery-powered backup circuit maintained in a dormant state to conserve energy until an actuation key is operated. A microprocessor of the unit is programmed to activate a relatively high frequency of power output pulses at the start of movement of a locking bolt by the electric motor, to overcome inertia and any sticking forces on the bolt, and a lower frequency of power pulses to complete the movement of the bolt.

Another example is provided in U.S. Pat. No. 4,674,781, to Reece et al., which discloses an electric door lock actuator and mechanism having manual and electrically driven locking means. This device utilizes a combination of a lost motion coupling and resilient springs for driving a motive means to a neutral position, to thereby isolate an electric motor and gearing from the locking means so that the locking means may be operated manually without back-driving of the electric motor and intermediate gearing.

A major problem with such devices is that they require substantial amounts of electric power to perform their locking and unlocking functions. For securely storing and accessing highly sensitive or valuable items, it is important to avoid depending on the ready availability of sufficient electrical power for driving the locking mechanism. In fact, for many applications, the use of long-life batteries, even to power a small microprocessor, may also be deemed unacceptable.

In short, for high security storage of sensitive or valuable material, in light of the availability of sophisticated computer-assisted means and methods for unauthorized operation of locking mechanisms, there exists a need for an autonomous locking mechanism that does not require batteries or external sources of power for any purpose, receives and recognizes only specific user-selected combination code information for access, emanates no information useful to persons attempting unauthorized operation, and is made to resist unauthorized operation even when subjected to strong externally imposed electrical, magnetic or mechanical forces, and satisfies other U.S. government specifications. Most important, once the mechanism is put in its locked position it loses all "memory" of the input combination code and requires a totally new and correct provision of the complete combination code to be unlocked again.

The present invention, as more fully disclosed hereinbelow, meets these perceived needs at reasonable cost with a geometrically compact, electrically autonomous, locking mechanism.

SUMMARY OF THE DISCLOSURE

It is an object of this invention to provide a locking mechanism which remains securely in a locked state until, following receipt of a predetermined combination code, a very small amount of electrical power is employed to put it in condition to be manually unlocked thereafter.

It is another object of this invention to provide a locking mechanism actuated by the input of a selected combination code followed by the delivery of a very small amount of electrical power generated during input of a user-selected combination code to a low friction engagement means to put the same in a position to enable purely manual unlocking of the mechanism thereafter.

Yet another object of this invention is to provide a locking mechanism which upon being put into a locked state remains in that state immune to electrical, magnetic, thermal or mechanical inputs accompanying attempts at unauthorized unlocking thereof.

It is an even further object of this invention to provide a secure locking mechanism which is unlocked by the provision of a preselected combination code within a specified time followed by the provision of a very small amount of electrical power to move an engagement element to a position to enable solely manual unlocking of the mechanism thereafter.

It is an even further object of this invention to provide a locking mechanism which utilizes a very small amount of electrical power, generated during input of a user-provided combination code, to be put into condition for manual unlocking, the mechanism, upon being manually put into a locked state, remaining in such a locked state until a predetermined combination code is entered.

These and other related objects are realized, according to a preferred embodiment of the invention, by providing a locking mechanism which comprises a first means for moving an engagement element from a disengaged position to an engageable position thereof solely upon receipt of a controlled predetermined electrical power output, a manually operated second means for engaging the engagement element when the latter is in its engageable position for thereby manually moving the first means further in a first direction and back in a second direction, and third means for driving a lock-bolt engaged by the further movement of the first means to drive the lock-bolt to locking and unlocking positions thereof in correspondence with movements of the first means in the first and second directions respectively. Movement of the first means in the second direction restores security by returning the engagement element to its disengaged position when the lock-bolt reaches its locked position.

In still another aspect of the invention, the first means comprises an electrical stepper motor having a rotor supporting the engagement element and having stable positions determined by magnetic detents which correspond to the disengaged and engageable positions of the engagement element.

DETAILED DESCRIPTION OF THE PREFERRED EMBODIMENTS

Figure 1:
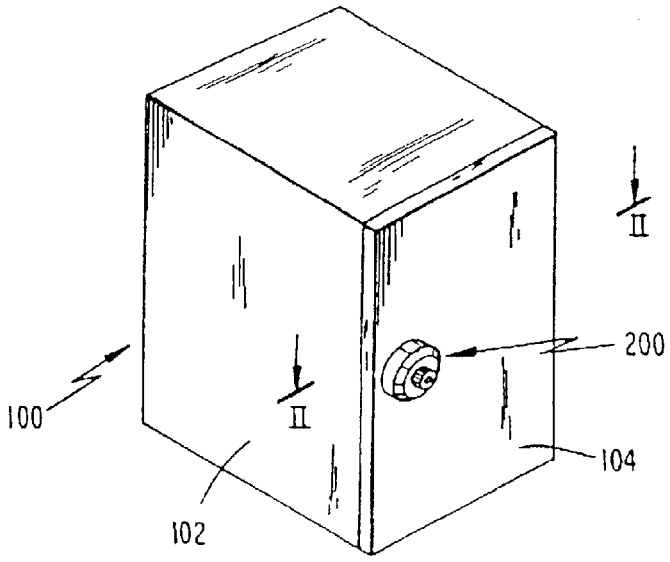
FIG. 1 is a perspective view of an exemplary safe having a generally rectangular casing and a hinged door, with a lock mechanism according to this invention mounted to the door of the safe.

A typical safe for securely storing valuable items, e.g., sensitive documents, precious jewelry or cash, hazardous materials such as radioactive or biologically dangerous substances, and the like, conveniently has a generally cubical form, with an opening closable by a single hinged door. Such a safe also typically has a multi-walled construction, both for the principal sides and for the door. As best seen in FIG. 1, such a safe 100 generally has a principal side wall 102 to which a door 104 is locked by operation of a lock mechanism 200.

Figure 2:
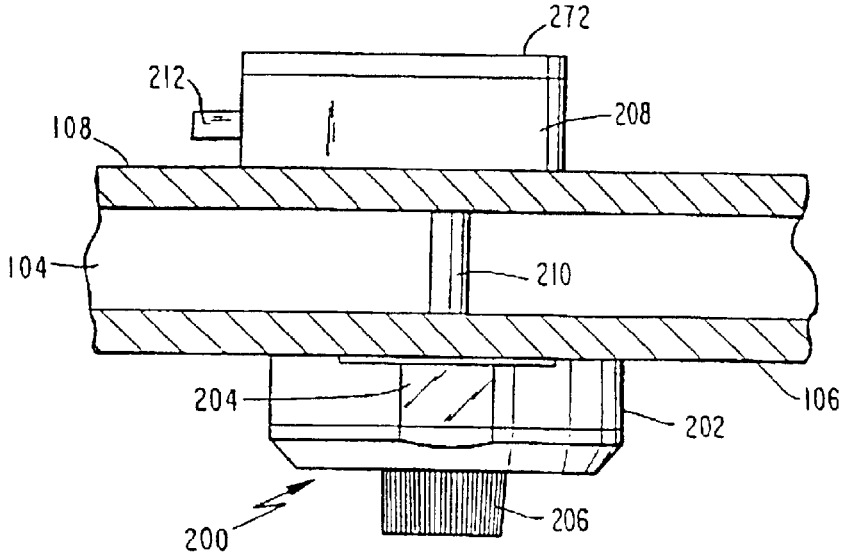
FIG. 2 is a horizontal cross-sectional view of the door and the lock mechanism at line II—II in FIG. 1.

As best seen in FIG. 2, a lock mechanism 200 according to a preferred embodiment of this invention has an external user-accessible hub 202 conveniently provided with an easily viewable combination code input display window 204 and a manually rotatable combination input knob 206. Hub 202 is attached to the outer surface 106 of door 104 in any known manner. Similarly, a casing 208 is securely attached to an inside surface 108 of door 104 in known manner. Door 104 may be kept hollow or may have an inner space filled with a thermally insulating material (not shown) to protect the contents of the safe in the event of a local fire.

A shaft 210, rotatable by knob 206, extends through the thickness of door 104 and into casing 208 to cooperate thereat with a combination of important elements of the present invention as described more fully hereinbelow. A lock-bolt 212 is slidably supported by casing 208 to an unlocking position, upon appropriate manual operation of combination-input know 206 by a user. Casing 208 is provided with a detachable cover 272 which also serves to provide support to various components of the lock mechanism according to this invention.

Figure 3:
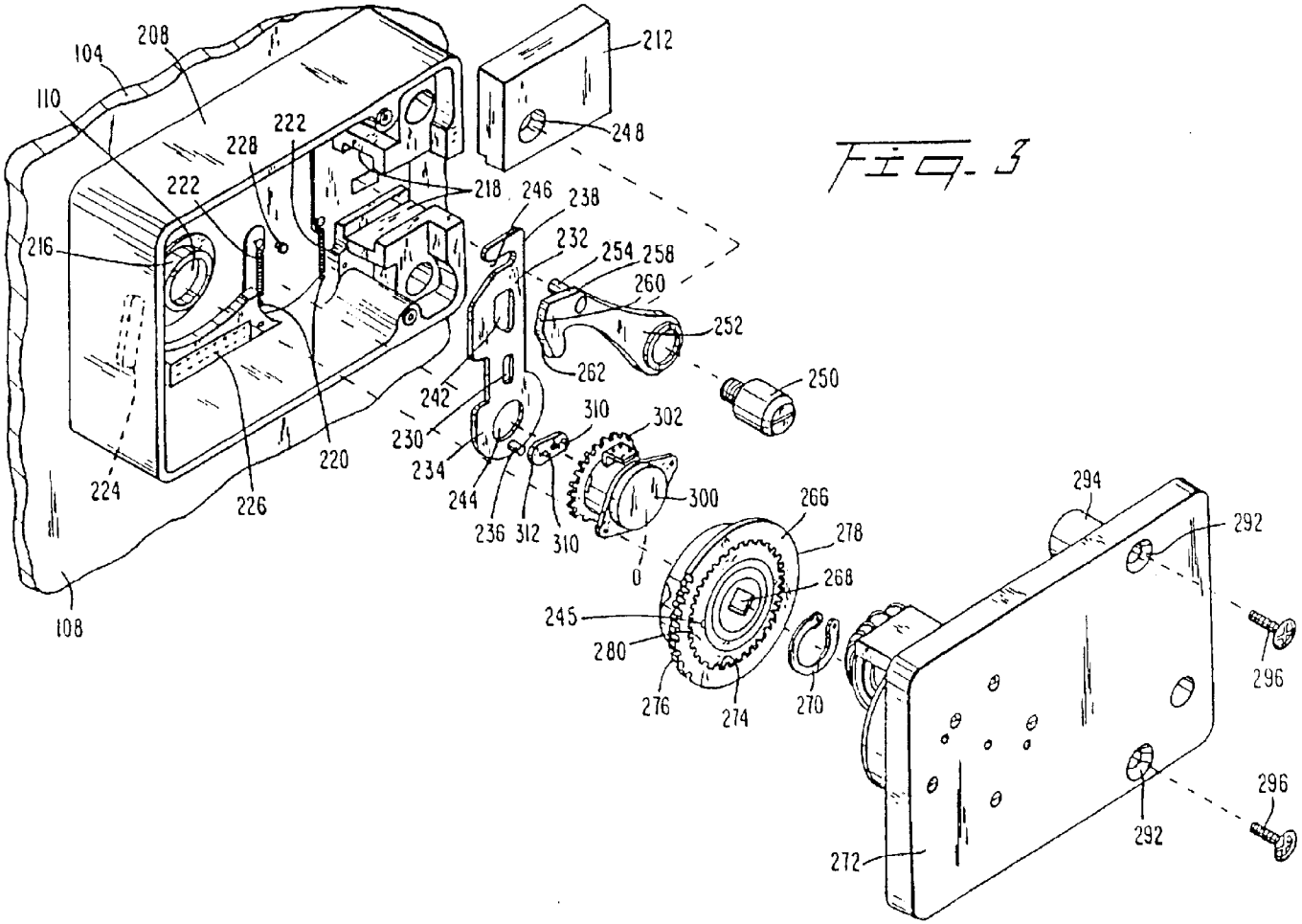
FIG. 3 is an exploded perspective view of a lock mechanism according to a preferred embodiment of this invention as viewed from a location behind a casing of the lock mechanism.

FIG. 3 is an exploded view of a lock mechanism according to a preferred embodiment of this invention, as viewed in looking toward the inside surface 108 of door 104. Persons of ordinary skill in the art can be expected to appreciate that it is not critical to the utility of the present invention that lock mechanism 200 be mounted to a door since, without difficulty, the lock mechanism can be easily mounted to a wall of safe 100 in such a manner that lock-bolt 212 projects in its locking position into the safe door to lock it to the body of the safe. Details of such an alternative construction are simple and easy to visualize, hence illustrations thereof are not included. Such structurally obvious variations are contemplated as being within the scope of this invention.

Referring again to FIG. 3, an aperture 110 extends through the entire thickness of door 104 to closely accommodate therein shaft 210 extending from combination-input knob 206 into a space 214 defined inside casing 208. Located in correspondence with aperture 110 in door 104, in casing 208 there is provided an annular journal bearing 216 to closely receive and rotatably support shaft 210 via 266 projecting therethrough into space 214.

Casing 208 is conveniently formed, e.g., by machining, molding or otherwise in known manner, to provide a pair of guide slots 218, 218 which are shaped, sized and disposed to closely accommodate lock-bolt 212 in a sliding motion between its locked and unlocked positions. While an important object of this invention is to provide its locking function in a highly compact manner, which inherently necessitates the selection of strong materials for forming the casing 208 and lock-bolt 212, guides 218, 218 and lock-bolt 212 must be shaped and sized to provide the necessary strength to resist any foreseeable brute-force to open door 104. Persons of ordinary skill in the art are expected to know of suitable materials for such purposes. For example, although the safe walls and door may be made of highly tempered steel or alloy, the lock bolt itself may be made of a softer metal such as brass or an alloy such as "ZAMAK," and so may other elements of the mechanism.

Figure 5:
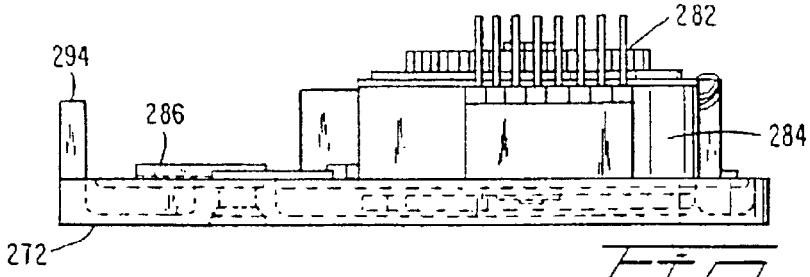
FIG. 5 is a plan view of the elements illustrated in FIG. 4 in the direction of arrow V therein.

As also illustrated in FIG. 3, within space 214 inside casing 208 there are also provided attachment points for biasing means such as springs 222, 222 to be employed as discussed hereinbelow. In the embodiment illustrated in FIG. 3, there are also provided at an inside surface of casing 208 a small reed switch 224 and a socket 226 disposed to enable push-in electrical connection of a plurality of electrical connector pins 282 which are best seen in FIG. 5. Also provided on a wall surface of casing 208 near biasing springs 222, 222 is a guide pin 228 which closely fits into an elongate parallel-sided aperture 230 in the sliding element 232 which is generally flat and slides along an inner surface of casing 208. Sliding element 232 is provided with a pair of spring-engaging pins 234, 234 which engage with biasing springs 222, 222, whereby sliding element 232 is biased in a preferred direction, an upward direction in the illustration per FIG. 3.

Note that sliding element 232 is also provided with a cam-engaging pin 236, at least one elongate straight side 238 which may be used in known manner to provide additional sliding guidance, one or more weight-reducing apertures such as 242 which may also be shaped to perform cam functions, a circular aperture 244 close to cam-engaging pin 236, and a cam-notch 246 at the end of sliding element 232 opposite the end closest to cam-engaging pin 236.

Lock-bolt 212, as best seen in FIG. 3, is provided with a pivot-mounting aperture 248 into which is mounted a pivot 250, to pivotably connect a lever arm 252 to lock-bolt 212 to communicate a manual force for moving the lock-bolt, guided by guides 218, 218, between its locked and unlocked positions.

Lever arm 252 is provided with a lateral pin 254 which is disposed to be engaged by cam-notch 246 of sliding element 232 so as to be forcibly moved thereby, in a manner to be described more fully hereinbelow, when sliding element 232 is itself caused to be slidingly moved as guided by the coaction of guide pin 22B and the parallel sides of elongate aperture 230. The distal portion of lever arm 252 extending beyond the location of lateral pin 254 is formed as a hook 256, the shape of which is provided with an outside edge having a plurality of contiguous portions 258, 260 and 262 which coact with a downwardly depending fixed cam portion 264 formed at an inside surface of casing 208. This coaction, at different stages in the course of moving lock-bolt 212 between its locked and unlocked positions, is best understood with successive reference to FIGS. 6A, 6B and 6C and is described more fully hereinbelow.

An end portion of shaft 210 which extends into space 214 preferably has a square cross-section, to which is mounted a rotary element 266 via a matchingly shaped and sized central fitting aperture 268, as best seen in FIG. 3. Accordingly, when a user of the safe manually applies a torque to the combination-input knob 206 (see FIG. 2), he or she transmits the torque to shaft 210 to thereby forcibly rotate rotary element 266. A split ring 270, for example, may be utilized to retain the rotary element 266 to shaft 210 in known manner. Other known techniques or structures may be used, instead of such a split ring, for such retention. By this arrangement, there is readily available, through rotary element 266, a manually provided torque at a point inside space 214 of casing 208, i.e., within the secure containment space inside safe 100, even when door 104 is locked. This is a feature essentially common to the various embodiments disclosed and claimed herein. The exact structural form of the manually-torqued rotary element is different, and is somewhat differently utilized, in the various embodiments.

In the best mode of this invention, exemplified by the preferred embodiment illustrated in exploded view in FIG. 3, rotary element 266, in a portion closest to an inside surface of cover 272 of casing 208, is provided an internal ring gear 274. Outwardly of ring gear 274, there is provided a periphery having a toothed arcuate portion 276, a smooth circumferential portion 278 and a radially relieved smooth circular portion 280.

At a side of rotary element 266 between internal ring gear 274 and annular journal bearing 216 is a circular cam portion 400 provided with a radially-relieved mechanical detent 402 shaped and sized to receive hook 256 when lever arm 252 is pivoted to a predetermined degree about pivot 250 by a sliding movement of sliding element 232 and a corresponding coaction between lateral pin 254 of lever arm 252 and cam notch 246 of sliding element 232. A small magnet 245 is mounted to rotary element 266, at a predetermined angular disposition vis-a-vis mechanical detent 402, at a radius such that it passes by reed switch 224 to activate it under conditions selected by microprocessor 288 as described hereinafter.

Figure 4:
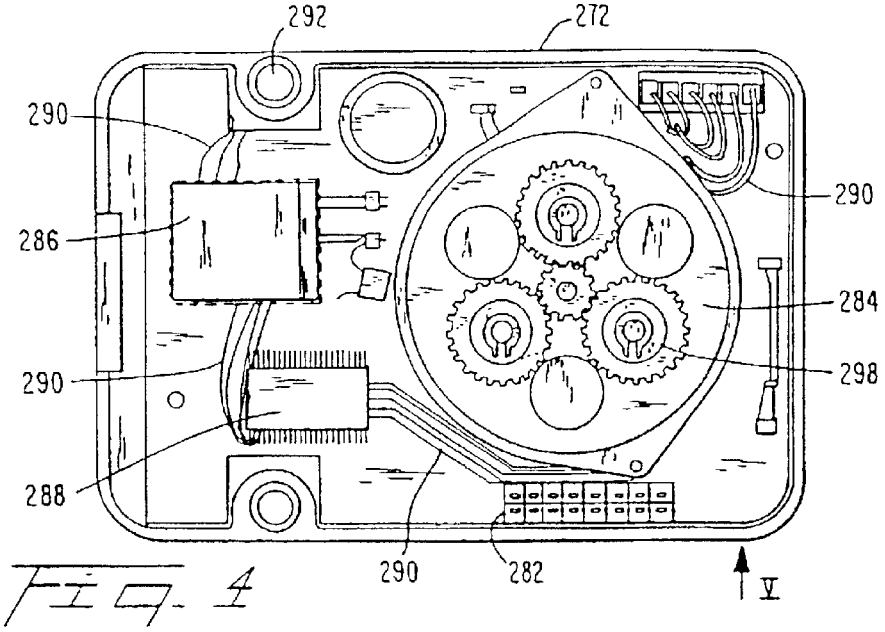
FIG. 4 is a vertical elevation view of elements of the lock mechanism which are mounted to a rear cover of a casing of a lock mechanism according to FIG. 3.

As best seen in FIG. 4, cover 272 on the side facing space 214 of casing 208 supports a plurally-pinned electrical plug element with pins 282 located to be electrically engageable with socket 226, an electrical power generator 284, a power storage capacitor 286, a microprocessor 288, and assorted wiring 290 forming part of an electrical circuit. Details of this electrical circuit and various aspects of its functions, e.g., how a predetermined combination code may be provided to and stored in microprocessor 288, how segments of a selected combination code are displayed in window 204 as they are input by a user operating manually rotatable combination-input knob 206, and the like, are disclosed in U.S. Pat. No. 5,061,923, which is expressly incorporated herein by reference for all such relevant disclosure therein.

Cover 272, as best seen in FIG. 3, is provided with countersunk apertures 292 and one or more location-indexing projections 294 to facilitate precise fitting of cover 272 with casing 208 and secure affixation therebetween by screws 296. When cover 272 is thus indexed and affixed to casing 208, a sun-and-planet gear train 298, best seen in FIG. 4, meshes with internal ring gear 274 of rotary element 266 to be rotated thereby, plug element 282 fits to socket 226, and lock-bolt 212 then is slidably movable in a closely fitting aperture of closed casing 208.

As described in detail in U.S. Pat. No. 5,061,923, incorporated herein by reference for such details, such affixation of cover 272 to casing 208, upon manual rotation of combination-input knob 206, causes rotation of shaft 210 and rotary element 266 mounted thereto, resulting in manual rotation of planetary gear train 298 to generate electrical power in electrical generator 284. Some of this electrical power is conveyed via a plurality of fine wires (not illustrated) which are disposed along shaft 210, to provide a liquid crystal display of numbers relating to a combination code in display window 204. A portion of the power generated by electrical power generator 284, under the control of microprocessor 288, is stored in power storage capacitor 286. Some of this stored electrical power is thereafter available for a period of time under the control of microprocessor 288, upon determination thereby that a correct combination code has been provided by a user, to perform a vital function of the present invention. This vital function is to create such a coaction of the above-described elements that lock-bolt 212 is positively and controllably moved, solely by a manually-provided force, from its locked position to its unlocked position.

In the best mode of this invention, as best understood with reference to FIG. 3, there is a very low-friction rotary, electric motor 300 provided with magnet detents symbolized by the reference character "D" in the figure, which give a rotor 302 at least two stable positions which are angularly separated with respect to an axis of the rotor by a predetermined angle, preferably approximately 36°. Such motors are known; one example is a Seiko model. Hence, detailed illustrations of the internal structure of motor 300, etc., are not believed necessary for an understanding of the structure or specific functioning of the present invention in any of the embodiments disclosed and claimed herein.

What is of particular importance is that motor 300 is electrically connected by a portion of circuit wiring 290 so as to be able to receive from power storage capacitor 286 at least one predetermined small pulse of electric power at a time controlled by microprocessor 288. Microprocessor 288 is initially provided a user-input reference combination code which, thereafter, serves as reference data until and unless it is replaced or changed as is fully described in copending application U.S. Ser. No. 07/250,918, incorporated herein by reference for relevant details disclosed therein. Subsequently, when a user rotates combination-input knob 206 to actuate the lock mechanism, rotation of shaft 210 (regardless of direction of its sense of rotation), generates electrical power to display elements of the combination code as they are being input and, simultaneously, enables the storage of a quantity of power in power storage capacitor 286. Then, upon microprocessor 288 recognizing that a correct combination code has been provided, e.g., upon receipt of a predetermined ordered set of three numbers, a portion of the power stored in power storage capacitor 286 is released to motor 300 when further rotation of rotary element 266 in a predetermined direction next brings magnet 245 close enough to reed switch 244 to actuate it. Alternatively, power can be supplied to the motor 300 by a separate capacitor (not shown).

This motor 300 has very low-friction bearings rotatably supporting rotor 203, preferably with no grease, oil or other lubricant being utilized therein to avoid deterioration thereof over prolonged period of time. The coaction of ring gear 274 and gear train 298 generates sufficient electrical power during the process of inputting the requisite combination code to enable power storage capacitor 286 to store and deliver an adequate electrical power pulse (or more than one pulse, as needed) to cause rotor 302 to move from a stable disengaged position corresponding to a first magnetic detent to a stable engageable position corresponding to a second magnetic detent thereof. Motor 300 thus functions as a transducer in which a small amount of received electrical power is converted, i.e., transduced, to a small mechanical rotation of rotor 302.

A variation of this arrangement can be realized using simple modifications to the circuitry, so that power to actuate the motor 300 is provided directly from power generation elements to the motor without first storing that quantity of electrical charge in one or more capacitors. Power to operate the microprocessor, however, may still be stored in and provided through one or more capacitors.

Figure 6A:
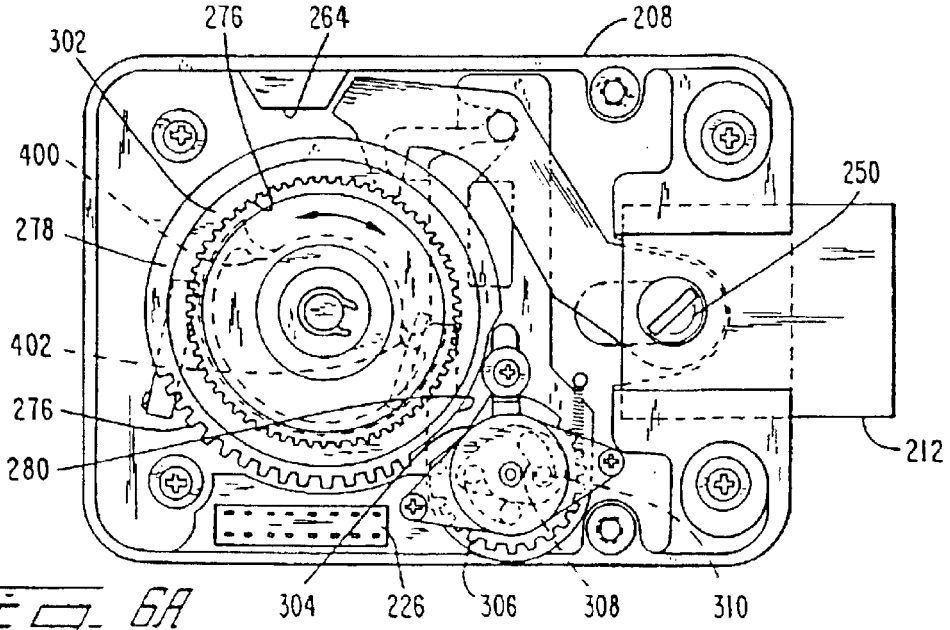
FIGS. 6A, 6B and 6C are elevation views of elements of the lock mechanism operationally supported to and within the casing of the lock mechanism of FIG. 3 to explain coaction of the elements at various stages as the lock-bolt is moved to an unlocked disposition thereof.
Figure 6B:
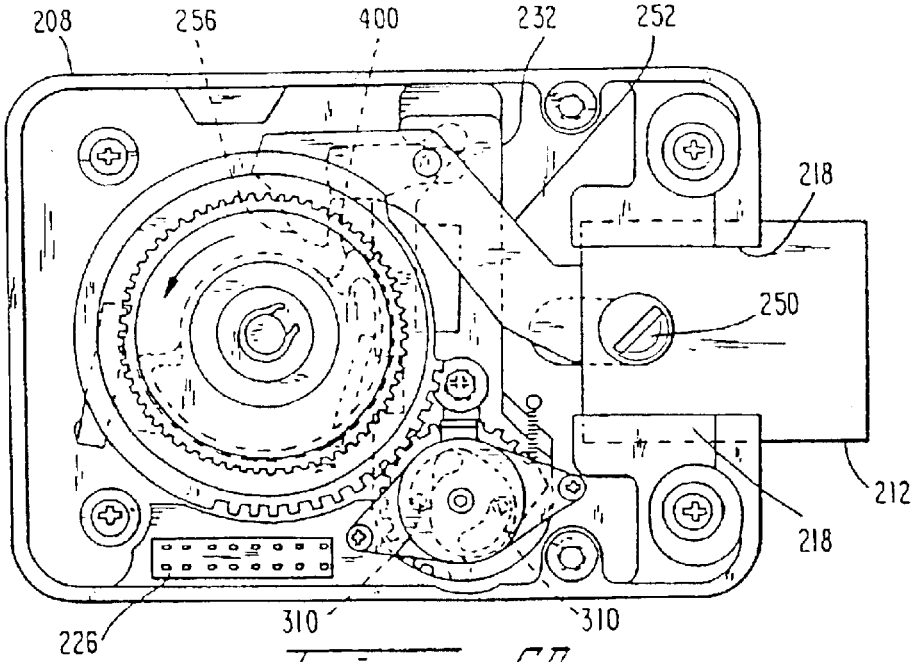

As best seen in FIG. 6A, rotor 302 has an arcuately relieved portion 304 disposed to be closest to and accommodating of the outer peripheral portion 276 of rotary element 266 when rotor 302 is in its disengaged position. In the best mode illustrated in FIGS. 6A–6C, a peripheral arcuate portion 306 of rotor 302 is provided with a plurality of teeth shaped and sized to be positively engageable with the teeth of toothed outer peripheral portion 276 of rotor element 266. Upon the provision of the requisite electric power pulse from power storage capacitor 286, as previously described, rotor 302 promptly rotates to its stable engageable position, this being one in which its toothed outer portion 306 is rotated to become engageable by teeth of peripherally toothed portion 276 of rotary element 266, i.e., when rotary element 266 is turned counterclockwise in FIGS. 6A, 68 and 6C to engage said teeth of portion 276 with the teeth of rotor 302.

Once such an engagement is initiated, further manual rotation of rotary element 266, due to manual torque provided by a user rotating combination-input knob 206, rotor 302 is forcibly and positively rotated in a rotational direction opposite to that of shaft 210. In other words, simply by the provision of a very small electrical power pulse, which is preferably in the range of only a few microwatts, rotor 302 becomes drivable solely by the manual rotary input under the control of the user, and this occurs only after the input of a correct combination code as recognized by microprocessor 288 with reference to its prestored reference combination code data.

Rotor 302, as best seen in FIG. 6A, in a face thereof closest to sliding element 232, has two arcuate, diametrally opposed, generally kidney-shaped openings 308, 308. These recesses are shaped and sized to non-bindingly receive therein a pair of drive pins 310, 310 provided on a rotatable cam element 312 which is mounted to be freely rotatable about the same axis as rotor 302 within angular limits imposed by arcuate recesses 308 coacting with drive pins 310. In other words, drive pins 310, when disposed to be located near corresponding ends of arcuate recesses 308 while rotor 302 is in its disengaged position, remain unmoved while the aforementioned electric power pulse causes rotor 302 to rotate to its stable engageable position, at which point drive pins 310 are located at the corresponding opposite ends of their respective recesses 308, 308. Note that this ensures that with only a few microwatts of power, rotor 302 rotates from its disengaged position to its engageable position. This is an important aspect of the present invention and is common to all disclosed embodiments. However, upon further manually forced rotation of rotor 302, arcuate recesses 308, 308 each forcibly engage with corresponding drive pins 310, 310 to forcibly rotate rotatable cam element 312. Rotatable cam element 312 is located so as to then, and only then, force a portion of its outer peripheral edge into contact with cam-engaging pin 236 of sliding element 232.

In this manner, further solely manual rotation of rotatable cam 312 will generate a forced sliding motion of sliding element 232, as guided by guide pin 228 engaging with elongate aperture 230, by overcoming of a biasing force provided by bias springs 222, 222. In the structure as illustrated in FIGS. 1 and 6A–6G the sliding element 232 thus is manually moved downward.

As previously noted, cam notch 246 at the upper distal end of sliding element 232 engages with lateral pin 254 of lever arm 252. Thus, as best understood with reference to FIGS. 6A, 6B and 6C, as sliding element 232 is forced downward, cam notch 246 thereof applies a downward pull on the hooked end of lever arm 252 to correspondingly pull hook 256 thereof downwardly toward a mechanical detent 402 provided on rotary element 266. In the illustrations per FIGS. 6A, 6B and 6C, as lever arm 252 is drawn downward to engage with mechanical detent 402, edge portion 260 thereof coacts with a sloping edge of fixed cam portion 264 to be further moved downward into a positive engagement with mechanical detent 402. Thus, as best seen with reference to FIG. 6B, the downward motion of sliding element 232, contact between the sloping edge of fixed cam portion 264 and the outside edge portions 258, 260 and 262 of lever arm 252, and the eventual engagement of hook 256 with mechanical detent 402 of rotary element 266 all, eventually, lead to a manually-provided force being transmitted by lever 252, through pivot 250, to forcibly draw lock-bolt 212 into casing 208. Ultimately, lock-bolt 212 becomes substantially drawn into casing 208 to its unlocked position.

Figure 6C:
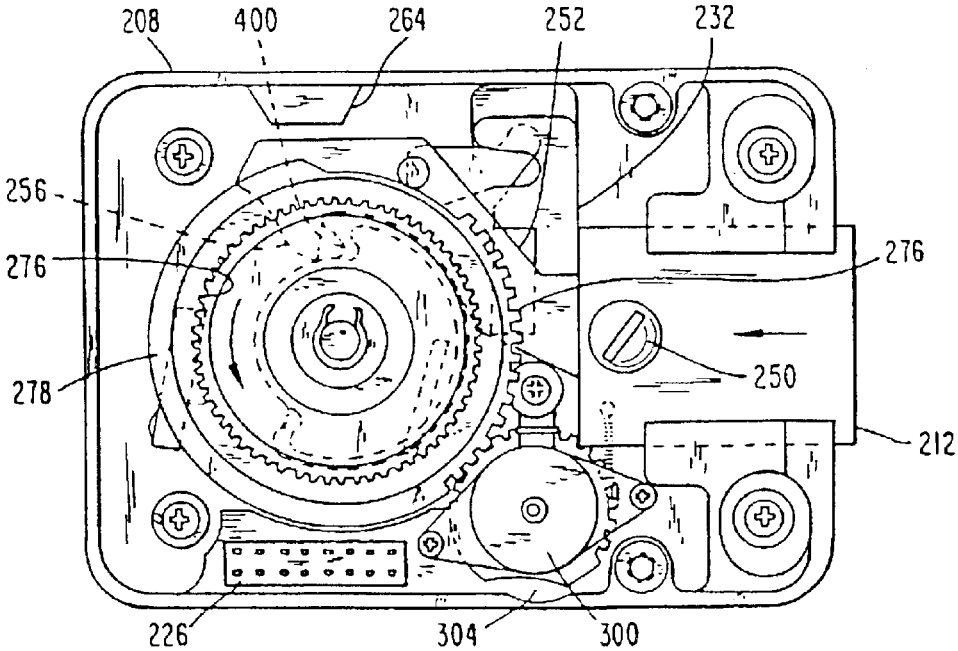

Also, as best understood with reference to FIG. 6C, when this state of affairs is reached, lever arm 252 can rotate no further about pivot 250 because it is then in forced contact with the radially outermost portions of the detented side of rotary element 266. Therefore, once lever arm 252 is engaged with rotary element 266 to draw lock-bolt 212 to its unlocked position, further forced rotation of combination-input knob 206 is prevented. Under these circumstances, door 104 may be opened and access may be had by the user to the contents of safe 100.

Once the user has completed his or her business with the contents of the safe, door 104 may be put in a position to close safe 100 and the combination-input knob 206 rotated in the opposite sense, i.e., in a direction opposite to that which enabled lock-bolt 212 to be manually moved to its unlocked position. As best understood with reference to FIG. 6A, as the relieved detent portion of rotary element 266 is thus rotated, coaction between the same and the outer edge portion 262 of lever arm 252 forces lever arm 252 upward and in a direction that will drive lock-bolt 212 out of casing 208 toward a locked position. In this process, as the distal end of lever arm 252 slips past fixed cam portion 264 of casing 208, lateral pin 254 of lever arm 252 is placed into engagement with cam notch 246 and serves to move sliding element upward while the biasing force provided by springs 222 also acts upward on sliding element 232. At the same time, as rotating element 266 rotates, the meshed teeth of peripheral portion 276 of rotating element 266 and the teeth of toothed portion 306 of rotor 302 move in engagement until rotor 302 is rotated to such an extent that arcuate relieved portion 304 thereof abuts the relieved portion of the periphery of rotary element 266.

Again, as best seen with reference to FIG. 6A, this united action of the above-described elements is such that when sliding bolt 212 eventually reaches its locked position, rotor 302 is returned to its stable disengaged position and will, thereafter, be retained there by the corresponding magnetic detent of motor 300.

Note that the rotation of rotary element 266 required to thus project lock-bolt 212 out of casing 208 into a locked position is minimal, and that very little electrical power is generated as an incident thereto. Consequently, the electrically discharged circuit does not acquire sufficient stored electrical charge to be able to influence stepper motor 300 while lock-bolt 212 moves from its unlocked to its locked position. A very important consequence of this, in the context of the present invention, is that the entire lock mechanism becomes totally deactivated upon lock-bolt 212 reaching its locked position. Once this happens, lock-bolt 212 can not be moved to its unlocked position without the provision of the correct and entire combination code which must be found satisfactory by microprocessor 288 to enable the unlocking process as described hereinabove. In short, once the door is locked, the only way to unlock it is to correctly provide the entire combination code.

The basic concept of this invention, as realized in the preferred embodiment described hereinabove, may also be practiced with other embodiments. One such embodiment 700 is illustrated, in various operational stages, in FIGS. 7A–7C. A detailed description of this second embodiment follows.

Figure 7A:
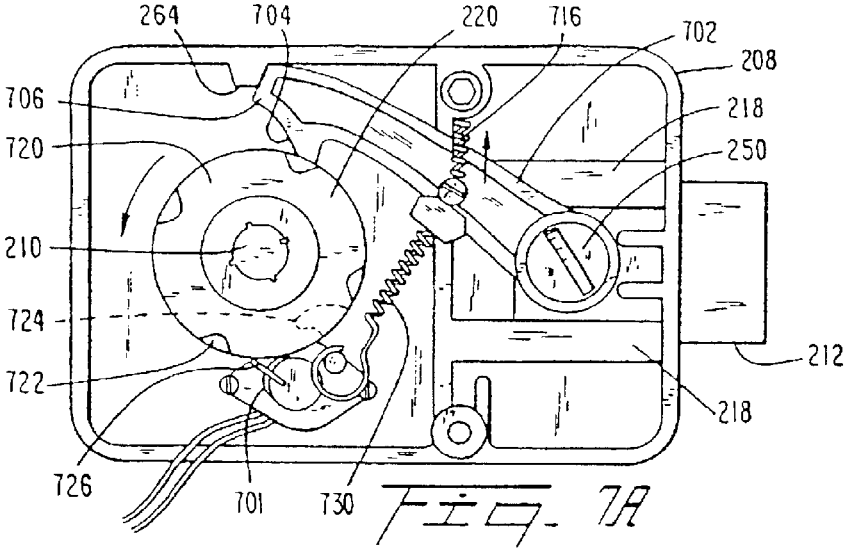
FIGS. 7A, 7B and 7C are vertical elevation views illustrating, for a second embodiment of this invention, how various elements of the invention coact at various stages as the lock-bolt is moved from its locked position to its unlocked position.
Figure 7B:
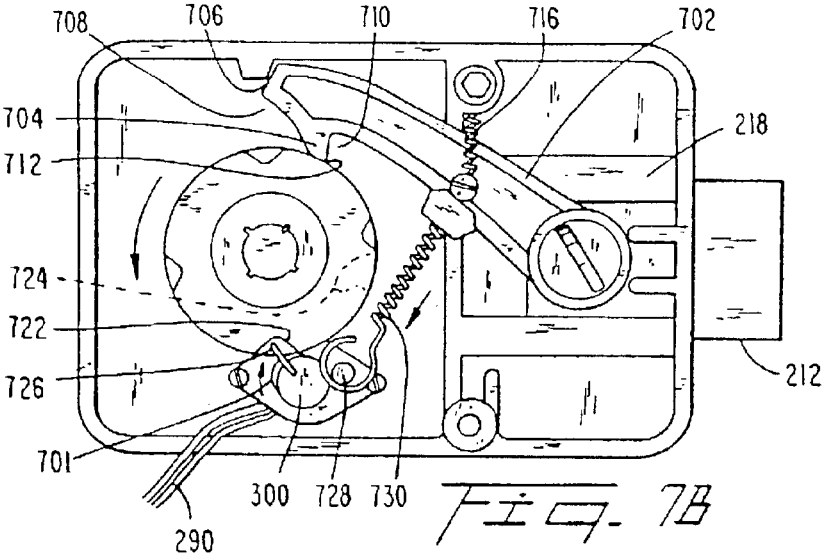
Figure 7C:
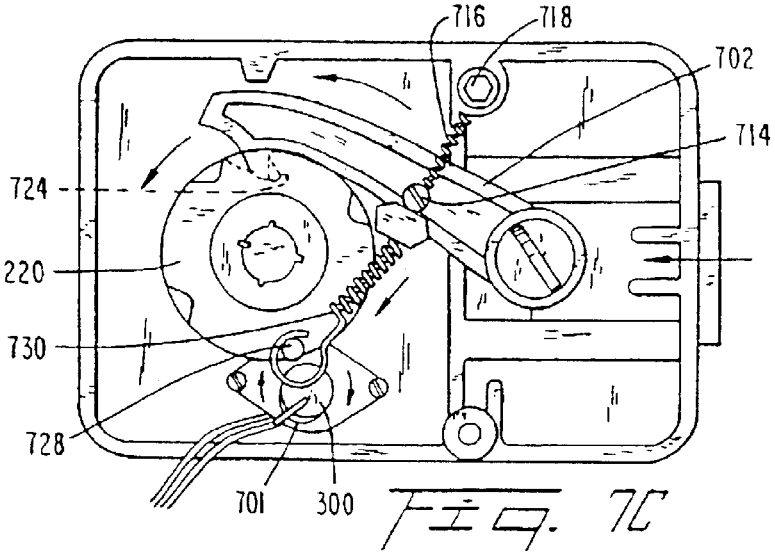

Referring to FIGS. 7A–7C, a view intended to be generally comparable to the view of the first embodiment, per FIG. 6A, a lock-bolt 212 is slidably guided within guides 218, 218 and a pivot 250 pivotably connects lock-bolt 212 to a lever arm 702 which has a hook 704 at a distal end thereof. The extreme distal end of lever arm 702 ends in a frontal surface 706, the shape of hook 704 being defined by an elongate curved surface 708 which meets a rear hook surface 710 at a point 712 of the hook. These surfaces are polished smooth. Lever arm 702, at a point intermediate its ends, is provided with a spring connection pin 714. A first spring 716, of selected length and stiffness, is hooked at one end to spring connection pin 714 and at another end to a first spring attachment point 718 at an upper portion of lock casing 208. Absent the application of an externally applied force, first spring 716 provides a sufficient biasing force to hold lever arm 702 with its smooth front surface 706 in contact with a matchingly inclined face of fixed cam 264 formed as part of casing 208.

In this second embodiment, as in the first embodiment illustrated in FIGS. 3–6C, there is provided a shaft 210 rotated by a user manually operating combination-input knob 206, as will be understood by reference to FIG. 2. Keyed to rotate with shaft 210 is a rotary cam element 720 which has an outer diameter such that when lever arm 702 is in its uppermost position, point 712 of hook 704 clears the circumferential rim of rotary cam element 720. In this circumferential periphery, there is provided a generally triangular detent 722 having inclined sides forming a vertex directed toward a rotational axis of rotary cam element 720, as best understood with reference to FIGS. 7A–7C. Rotary cam element 720 is also provided with a hook-engaging detent 724 formed and shaped to be able to accommodate hook 704 of lever arm 702 under conditions described hereinafter.

A low-friction, low-power, electric motor 300 is provided to receive a controlled electrical power pulse under the same conditions and in substantially the same manner as was described in detail for the first embodiment. Rotation of shaft 210 by a user, through a sun and gear train mounted on shaft 210, will generate and store some electrical power under the control of a microprocessor. Upon satisfactory reception of a correct combination code input from a user, the microprocessor will release from an electrical storage capacitor a small controlled pulse of electrical power to cause a rotor of electric motor 300 to rotate from a first stable "disengaged" position to a second stable "engageable" position, these positions being defined by corresponding magnetic detents. For the sake of conciseness, a detailed description is not repeated herein of the manner in which the electrical power is generated and how, upon being provided the correct combination code input the microprocessor provides the necessary small electrical power pulse to motor 300 to cause the rotor thereof to turn. These details are believed to be comprehensible to a person of ordinary skill in the art upon a study of the earlier provided detailed description.

In the second embodiment 700, as best seen in FIGS. 7A–7C, the rotor of electric motor 300 is provided with a generally radially extending engagement lever 726 and a radially eccentric elastic cam element 701. Engagement lever 726 and eccentric cam 701 are thus mounted to be rotatable with the rotor (not expressly shown) of motor 300. When the rotor of motor 300 is in its disengaged position, eccentric cam 701 has its periphery close to but not in contact with the circumferential periphery of rotary cam element 720 and the distal end of engagement lever 726 is located away therefrom. However, reception of the predetermined small electrical power pulse by motor 300, (clockwise in FIGS. 7A–7C) causes eccentric cam 701 to contact the periphery of rotary cam element 720. Frictional force thus generated causes the rotor to be turned manually thereafter, and engagement lever 726 is thus positively moved to extend into triangular detent 722. Continued manual rotation of the rotary cam element 720 thereafter forcibly and manually rotates the rotor of motor 300.

It will be recalled that the location of a small magnet on the rotary element of the first embodiment actuates a reed switch 224 when the rotary element 266 turned to a predetermined position after reception by the microprocessor of a correct and complete combination input signal. For the sake of conciseness and clarity the details of such operation are not repeated and such elements are not illustrated in FIGS. 7A–7C, but it will be understood that such components are present and cooperate in the manner previously described. Thus, upon reception of a complete and correct combination input by the microprocessor in the second embodiment, motor 300 receives the required small electrical power pulse and rotates its rotor so that the distal end of engagement lever 726, assists by movement of the elastic eccentric cam 701 caused by the power pulse to the motor 300 and subsequent rotor rotation friction between the elastic eccentric cam 701 and the contacting periphery of rotary cam element 720 permitting rotation of the rotary cam element 720, rotates into triangular detent 722 of manually rotated rotary cam element 720.

As was the case in the first embodiment, there is provided a rotatable element (not shown in FIGS. 7A–7C, but similar to 312 in FIG. 3) mounted to rotate freely about the axis of motor 300. Thus, when motor 300 has rotated its rotor by a predetermined small amount after receiving the small electrical pulse, the rotatable cam element 312 engages, and rotates a radial arm ending in a transverse cam pin 728. See FIGS. 7A–7C. Rotation of cam pin 728 about the axis of the motor is thus obtained by the application of a manual torque by coaction of the rotary cam element 720 and engagement lever 726 engaged therewith.

A second spring 730 is engaged at one end to spring connection pin 714 of lever arm 702 and has a second end disposed to be pulled by cam pin 728. The length of second spring 730 is selected such that it is put under tension only after engagement of engagement lever 726 by detent 722 of rotary cam element 720 as described in the immediately preceding paragraphs. Until that happens, second spring 730 is not subjected to any external force. However, once cam pin 728 is manually moved, as described above, it turns about the axis of motor 300 to a point where it begins to exert a force along second spring 730 and this force is to spring connection pin 714 of lever arm 752. This force, manually provided, is sufficient to overcome the biasing force of first spring 716, and eventually draws lever arm 702 to be drawn forcibly to thereby draw lock bolt 212 from its locking position to its unlocking position (as best seen in FIG. 7C).

The second embodiment thus operates in the manner just described in accordance with the same basic principles as were earlier described with reference to the first embodiment.

When the user wishes to lock the mechanism, he or she simply needs to turn combination-input knob 206, and thus shaft 210 and rotary cam element 720, in a clockwise direction as would be seen with reference to FIG. 7C, i.e., in a direction contrary to that in which it was turned to bring lock bolt 212 into its unlocking position. When this is done, forcible co-action between the profiled hook engaging detent 724 and the elongate curved leading face 708 of hook 704 causes lever arm 702 to rotate about pivot 250 while applying a manually provided force to drive lock bolt 212 to its locking position. Eventually, when rotary cam element 720 has rotated sufficiently, co-action between triangular detent 722 and engagement lever 726 will cause the tension force in second spring 730 to be relieved and the rotor of motor 300 will return to its disengaged position as controlled by the corresponding magnetic detent. Once this is accomplished, the biasing force provided by first spring 71 6 will return lever arm 702 to the position best seen in FIG. 7A. Since hook 704 is then no longer in contact with rotary cam element 720 at this time, any unauthorized rotation of shaft 210 will not succeed in unlocking the locking mechanism. Only the provision of a complete and correct combination code input can thereafter reactuate the mechanism and cause it to move to its unlocking position. There is, thus, provided an alternative simple structure for a locking mechanism.

Figure 8A:
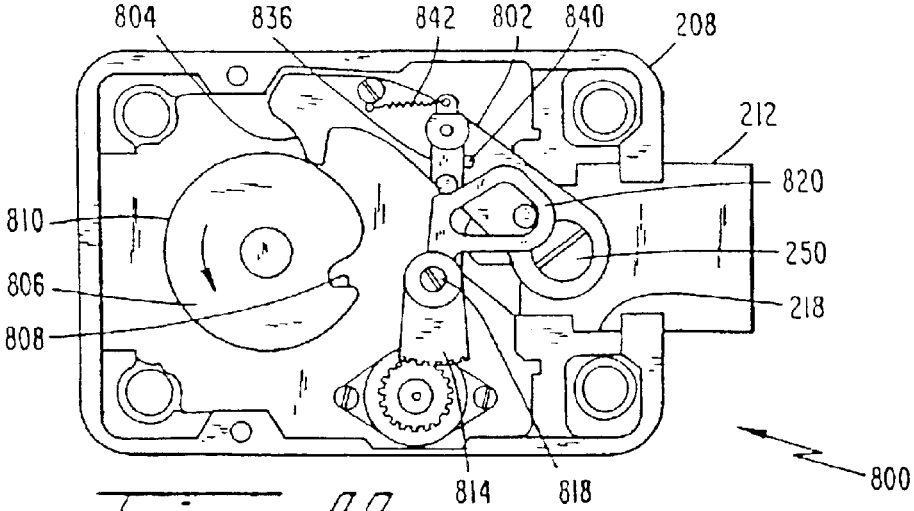
FIGS. 8A, 8B and 8C are elevation views, according to a third embodiment of this invention, illustrating various stages in the movement of the lock-bolt thereof from its locked to its unlocked position.
Figure 8B:
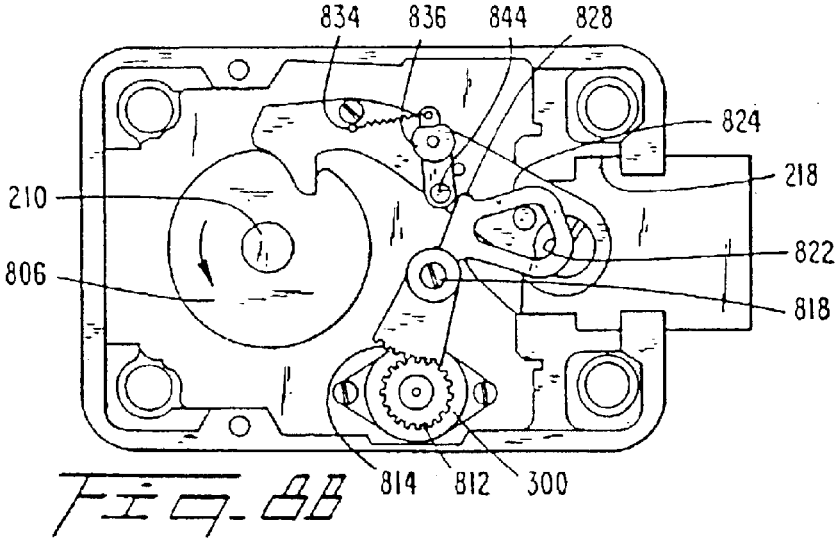
Figure 8C:
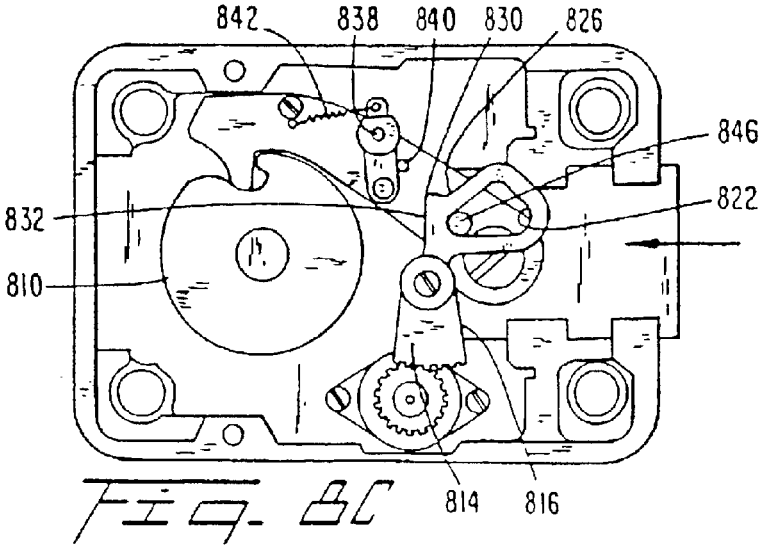

The third embodiment 800, operating to the same basic principles, is illustrated in FIGS. 8A–8C. In this embodiment, the elements for generating electrical power and controlling its delivery to motor 300 are as previously described. Lock bolt 212 is slidingly guided in guides 218, 218 as before. Lever arm 802 is pivotable about pivot 250 and has, as in second embodiment 700, a hook 804 at a distal end. A rotary cam element 806 is manually rotatable by affixation to shaft 210. Rotary cam element 806 has a hook-engaging profiled detent 808, with an otherwise smooth circumferential periphery 810 smoothly contiguous therewith.

The rotor of electric motor 300 has a gear wheel 812 the teeth of which are continuously engaged with the teeth of an arcuate toothed sector 814 of an element 816 pivotably mounted at a pivot 818 attached to an inside surface of casing 208. Element 816, on the side opposite to toothed sector 814, has a sideways extension 820 having a generally triangular internal opening 822 and an external edge surface cam comprising a first straight portion 824, an obtuse angle 826, a short external edge portion 828, a substantially right angled corner 830, and a second straight edge portion 832, as illustrated in FIGS. 8A–8C.

Lever arm 802 has a spring connection point 834, a short rotatable arm 836 pivotably mounted on a pivot 838 and a stop pin 840 against which short rotatable arm 836 rests under a biasing force provided by a spring 842.

As illustrated in FIG. 8A, when lock bolt 212 is in its locking position, i.e., projecting outwardly of casing 208, lever arm 802 has its distal end and hook 804 in their uppermost position, with hook 804 barely touching the smooth circumferential periphery 810 of rotary element 806. At this time, a cam pin 844, extending transversely of short rotatable arm 836 near an end opposite to an end attached to spring 842, is close to but not contacting the cam surface edge of element 816 at obtuse angle 826 thereof. See FIG. 8A.

When a user inputs the correct and complete combination code, as with the previously discussed embodiments, a microprocessor acts in combination with the reed switch and a magnet (not shown) mounted to the rotary element 806 in the manner previously described with respect to the other embodiments. A small electrical power pulse is then provided to electric motor 300 when hook-engaging detent 808 is at a predetermined position with respect to hook 804. Pivotably supported element 816 is very light in weight, therefore has a small mass inertia, and is supported at pivot 818 with very little friction, preferably without the use of lubricants that could deteriorate over time. It is also intended to be balanced about pivot 818 so that, even with a very small electrical power pulse, motor 300 can turn gear wheel 812 and, thereby, element 816. At this time, in the disposition illustrated in FIG. 8A, a lever arm cam pin 846 is at a first corner of opening 822 of element 816.

Upon receiving the small electrical pulse, motor 300 causes rotation of its rotor and gear wheel 812 mounted thereto, and toothed sector 814 engaged therewith causes rotation of element 816 in a clockwise direction, preferably by about 30°, as illustrated in FIGS. 8A–8C. The short cam surface edge portion 828 then slips away from under cam pin 844, lever arm cam pin 846 coacts with an inside edge of triangular opening 822 to pivot lever arm 804 about pivot 250 so that hook 804 can then make contact against circumferential periphery 810.

Eventually, as rotary cam element 806 is manually turned counterclockwise, hook 804 enters hook-engaging detent 808 of manually rotated rotary element 806. Once this occurs, further counterclockwise manual rotation of rotary element 806 forcibly pulls lever arm 802 leftward, and thus lock bolt 212 slides into casing 208. An uppermost outer edge of the hooked distal end of lever arm 802 slips under fixed cam 264 provided at an upper portion of casing 208. The dimensions of the various elements are selected so that when lock bolt 212 has reached its "unlocking" position detent 808, the hook engaging detent 808 can not pull on lever arm 802 any further, as best understood with reference to FIG. 8C. The locking mechanism is now in its unlocked state.

Note that, as with the two previously described embodiments, in this third embodiment the basic principle utilized is to employ a very small electrical power pulse to cause a light-weight, low-friction electric motor to cause a small rotatable element to rotate to initiate an engagement between a lever arm and a manually driven rotatable rotary element to enable delivery of a manual force to drive lock bolt 212 from its locking to its unlocking position. Note also that, as with the previous embodiments, such an engagement becomes possible only after the microprocessor has received a correct and complete combination code input from the user, and only when the user manually torques rotary element 806 thereafter.

In order to put the locking mechanism in its locking state, the user must manually rotate rotary element 806 in the contrary direction, i.e., clockwise in FIG. 8C. Co-action between the smooth, curved, outer edge of hook 804 and hook-engaging detent 808 will then cause a manually provided force to drive lock bolt 212 to its locking position rightward and, at the same time, once cam pin 844 contacts the second straight edge portion 832, element 816 will be caused to also rotate in a clockwise manner under a bias force conveyed from spring 842. Due to the engagement between toothed sector 814 and gear wheel 812 of motor 300, the motor also is thus returned to its disengaged detent-controlled position. At this time, under the urging of spring 842 acting on rotatable arm 836, cam pin 844 will again return to its location inside obtuse angle 826 of the cam surface edge of element 816. Rotary element 806 will have rotated so that its smooth outer circumferential periphery is now immediately adjacent hook 804.

Further uncontrolled, e.g., unauthorized, rotation of shaft 210 and rotary element 806 will not cause a lock-opening engagement between hook 804 and hook-engaging detent 808 until and unless element 816 is again caused to rotate out of the way of cam pin 844, this being possible only under the control of the microprocessor after the microprocessor receives a correct and complete combination code input. The lock is thus safe from unauthorized opening once lock bolt 212 is put in its "locking" position, i.e., once it is extended outwardly of casing 208 as best illustrated in FIG. 8A.

As will be appreciated, to ensure against forcible or clever attempts at unauthorized unlocking operation of the locking mechanism, additional security elements may be provided. Two embodiments of such an aspect of an improving addition to the above-described invention are illustrated in FIGS. 9, 10 and 10A, as described more fully hereinbelow.

Figure 9:
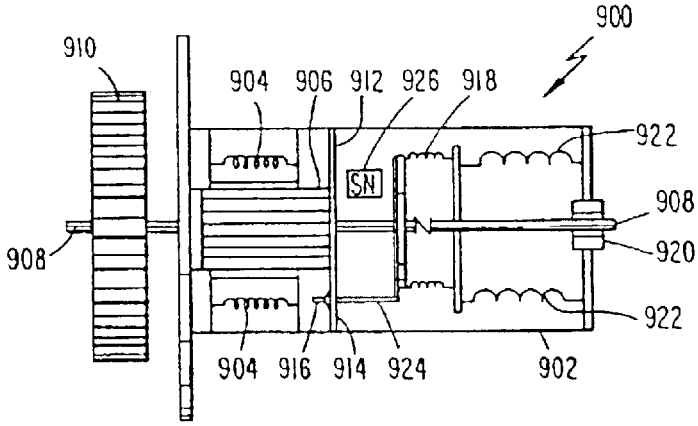
FIG. 9 is a partial vertical cross-sectional view of one embodiment of another aspect of this invention, in which a voice coil is employed to ensure against unauthorized magnetically induced unlocking of the mechanism.
Figure 10:
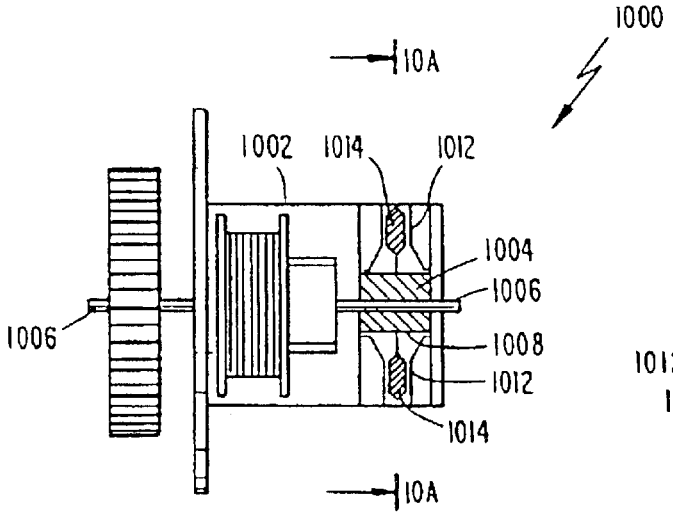
FIG. 10 is a partial vertical cross-sectional view of another embodiment of the aspect shown in FIG. 9.
Figure 10A:
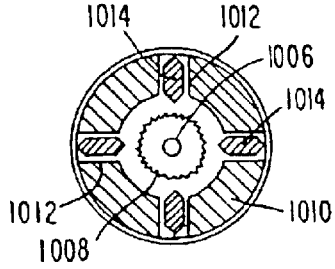
FIG. 10A is a vertical cross-sectional view at section XI—XI in FIG. 10.

FIG. 9 illustrates a mechanism that can act in combination with any of the above-described embodiments to further ensure against attempts at unauthorized operation of the locking mechanism by the imposition of an external magnetic field.

This security device 900 preferably has its principal components disposed within a common casing 902 shared with the electrical windings 904 and rotor 906 of the electrical motor (otherwise used in the same manner as electric motor 300 of the previous embodiments). Rotor 906 is supported on an axle 908 mounted in low friction bearings (not shown) and has an external gear wheel 910 which mechanically coacts with other elements as previously described.

At the inside end of rotor 906, within casing 902, there is provided a blocking member formed as a non-magnetic disk 912 which clears the inside surface of casing 902 and is rotatable with rotor 906 and shaft 908 to which external gear wheel 910 is mounted. Therefore, when blocking member disk 912 is prevented from rotating, so is external gear wheel 910 which, by its coaction with other elements previously described, is operable to put the lock in condition for unlocking.

Non-magnetic locking member disk 912 is preferably provided with a slight recess 914, as best seen in FIG. 9, with a through aperture 916 passing through the recessed portion to selectively receive a pin therethrough.

Also mounted within casing 902 is a small magnetic coil, e.g., a voice coil 918 mounted concentrically with an extending portion of axle 908 supported at a rear wall of casing 902 in a bearing 920. The voice coil is free to move axially of axle 908 and is biased toward rotor 906 and blocking member disk 912 by one or more springs 922 acting against the back end of and within casing 902. At the end of voice coil 918 closest to blocking member disk 912, there is mounted a cantilevered pin 924 which normally extends through aperture 916 in blocking member disk 912, as shown in FIG. 9. This is the normal situation when the lock is in its locked state. Voice coil 918 is not rotatable about or with axle 908 but can merely slide axially thereof.

A permanent magnet 926 is mounted inside casing 902 with its north and south poles aligned in such a manner that when an electric current is provided to voice coil 918, an electromagnetic field generated therein produces a pole of like kind so that mounted permanent magnet 926 repells voice coil 918 axially of axle 908. Consequently, when a sufficient electric current is provided to voice coil 918, and the magnetic field thereof interacts with permanent magnet 926 to overcome the biasing force of springs 922, voice coil 918 bodily moves away from blocking member disk 912. In doing so, it causes pin 924 to be totally extracted from aperture 916 in blocking member disk 912. So long as such a current continues to be provided to voice coil 918, and pin 924 remains retracted entirely out of aperture 916 in blocking member disk 912, blocking member disk 912, rotor 906, shaft 908 and external gear wheel 910 are then free to rotate. On the other hand, so long as such an electrical current is not being provided to voice coil 918, springs 922 force it in such a direction that when the distal end of pin 924 becomes aligned with aperture 916 in blocking member disk 912 it projects therethrough and prevents rotation of axle 908 and external gear wheel 910 mounted thereto.

In known manner, voice coil 918 is connected in conjunction with windings 904 of the electric motor (not numbered), which is used in the same manner as electric motor 300 of the previous embodiments. The electric current which activates voice coil 918 into retracting pin 924 out of blocking member disk 912 does so just before passing of electric current through windings 904 causes rotor 906 to turn axle 908 and, thus, external gear wheel 910.

As will be appreciated, to avoid binding between pin 924 and the edges defining aperture 916 in blocking member disk 912, the pin must be retracted before windings 904 generate enough torque on rotor 906 and blocking member disk 912 to turn them inside casing 902. As a practical matter, there are numerous known mechanisms and techniques for delaying the flow of electrical current to coils 904 until pin 924 has been entirely retracted from aperture 916, thereby setting rotor 906 free to turn.

In practice, the security device illustrated in FIG. 9 acts to prevent rotation of external gear wheel 910 under the action of an external spurious or intentionally applied magnetic field, which, otherwise, might actually cause rotation of rotor 906. Thus, if an unauthorized person positions equipment capable of generating a strong rotating field immediately adjacent the locking device of this invention, and rotor 906 rotates by coacting with the imposed rotating field, the lock might be engaged and unlocked without the input of an authorized combination code. The security device illustrated in FIG. 9 would prevent such unauthorized opening of the lock. Since the externally imposed unauthorized rotating electromagnetic field would have no influence on the non-rotatable voice coil 918 and its pin 924 extended through aperture 916, such a very small light pin 924 very efficiently prevents unauthorized rotation of axis 908 and external gear wheel 910.

It may be theoretically possible to apply a strong inertial force, e.g., by a violent blow, to the lock along the direction of the axis of axle 908, sufficient to cause voice coil 918 to compress springs 922. While doing so, in theory one could retract pin 924 from aperture 916 while, simultaneously, applying a strong rotating external magnetic field to rotate rotor 906. However, since most safes are very heavy or are built into a structure, the likelihood of such a complex contrivance putting the lock into condition for unlocking for practical purposes is eliminated by the presence of the security device per FIG. 9.

Persons of ordinary skill in the art will appreciate that the performance of the voice coil and pin 924 attached thereto, involving retraction during the provision of a small electric current to the voice coil, can be utilized under other comparable circumstances to prevent movement of an element capable of coacting with pin 924, e.g., a sliding element that may be employed as a magnetic key, or the like.

Voice coil 918 is preferably connected in series with winding coils 904 of the electric motor in such a manner that when an electrical current is provided under the control of the microprocessor to enable rotor 906 to turn, the same current causes voice coil 918 to act against springs 922 to withdraw pin 924 from aperture 916 of disk 912. Only then can disk 912 and the rotor 906 turn to rotate the toothed element 910 into an engageable position to allow the user to apply manual force to lock bolt 212 to move it to its unlocking position. Rotation of rotor 906 by the imposition of an external magnetic field is prevented by this simple structure, while normal authorized opening of the lock mechanism is automatically made possible.

In this manner, by the use of relatively inexpensive and commonly available elements, e.g., a voice coil, springs and essential wiring, additional security can be provided against unauthorized unlocking of the locking mechanism as described hereinabove.

An alternative security device is illustrated in FIGS. 10 and 10A. In such a device, shown sharing a common ferrous casing 1002, electric motor 300 utilizes a small rotor 1004 mounted coaxially to the motor axle 1006, rotor 1004 having a knurled or otherwise roughened outer peripheral surface 1008. Surrounding rotor 1004, but at a small distance radially outward therefrom, is an annular ring 1010 of a non-ferrous material tightly fitted within ferrous casing 1002.

As best seen in FIG. 10A, at four equally separated radial locations in non-ferrous annular ring 1010, there are provided four radial holes 1012 having axes in a common plane. Inside each radial hole 1012, there is provided a small hardened linear magnet 1014 which is shaped and sized to be freely slidable within radial hole 1012. Each of the hardened magnets 1014 has a sharp point at its end nearest to the knurled surface 1008 of rotor 1004. These magnets 1014 are disposed in pairs, with the two magnets of each pair having "like magnetic poles" opposite to each other in a substantially radial direction with respect to the axis of axle 1006 of electric motor 300. By this arrangement, the two magnets in each pair of magnets tend to repel each other so that they remain loosely held within their corresponding radial holes 1012 but with their respective sharp points magnetically maintained away from the knurled surface 1008 of rotor 1004.

Under the above-described circumstances, with the magnets, by pairs, staying away from the knurled surface 1008, the rotor of electric motor 300 remains free to operate as described previously, i.e., to turn between its two detent positions upon the reception of the required small electrical power pulse under the control of the microprocessor.

However, should an unauthorized attempt be made to unlock the locking mechanism by the imposition of a large magnetic field upon the locking mechanism, the pairs of magnets will no longer balance each other radially outwardly and, therefore, their sharp ends will come into contact with knurled surface 1008 of rotor 1004 and will prevent rotation thereof. Consequently, the rotor of electric motor 300 also cannot turn and the mechanism cannot be put into condition for operation in any of its embodiments as described hereinabove. This mechanism thus insures safety against attempts at unauthorized opening of the locking mechanism by the imposition of extraneously provided large magnetic or electrical fields.

It should be appreciated that persons of ordinary skill in the art, armed with the above disclosure, will consider variations and modifications of the disclosed embodiments and various aspects of this invention. Consequently, the disclosed embodiments are intended to be merely illustrative in nature and not as limiting. The scope of this invention, therefore, is limited solely by the claims appended below.

What is claimed is:

1. A self-powered electric lock comprising:

a lock-bolt mounted for linear movement between locked and unlocked positions;

a rotatable cam element having disengaged and engageable positions;

an electric actuator having a rotatable output operative to rotate said rotatable cam element to the engageable position thereof;

a lever arm pivotally coupled to said lock-bolt and operatively coupled to said rotatable cam element when said rotatable cam element is in the engageable position to thereby facilitate pivotal movement of said lever arm;

an electronic combination number input device electrically coupled with said electric actuator to cause said rotatable output to rotate said rotatable cam element to the engageable position thereof upon input of a correct combination number code to said electronic combination number input device; and an electricity generator operatively coupled to said electric actuator to supply power for operating said electric actuator;

a rotatable dial operatively coupled to said electronic combination number input device to allow input of the combination number code through rotation thereof and further coupleable to said lever arm when said rotatable cam element is in said engageable position; and a spring operatively coupled to said lever arm to pivot said lever arm into a position in which said lever arm is operatively coupled to said rotatable dial when said rotatable cam element is in said engageable position thereby allowing retraction of said lock-bolt by rotating said dial and pulling said lever arm.

2. The self-powered lock of claim 1, wherein said electricity generator is further operatively coupled to said electronic combination number input device to supply power for operating said electronic combination number input device.

3. The self-powered lock of claim 1, further comprising:

an electricity storing device operatively coupled to said electricity generator and said electric actuator, said electricity storing device operative to store sufficient electricity from said electricity generator to operate said electric actuator.

4. The self-powered lock of claim 1, wherein said electric actuator further comprises a stepper motor.

5. The self-powered lock of claim 1, wherein said rotatable dial is operatively coupleable to said rotatable cam element such that rotation of said dial causes said rotatable cam element to move from the engageable position to the disengaged position.

* * * * *

UNITED STATES PATENT AND TRADEMARK OFFICE

CERTIFICATE OF CORRECTION

PATENT NO. : 6,813,917 B2
DATED : November 9, 2004
INVENTOR(S) : J. Clayton Miller et al.

It is certified that error appears in the above-identified patent and that said Letters Patent is hereby corrected as shown below:

Column 1,
Line 28, change “to,” to -- to --.

Column 4,
Line 31, after “knob” insert -- or dial --.
Line 44, change “know” to -- knob --.

Column 5,
Line 1, after “via” insert -- rotary element --.
Line 56, change “22B” to -- 228 --.

Column 8,
Line 28, after “68” to -- 6B --.

Column 9,
Line 6, change “6G” to -- 6C --.

Column 11,
Line 35, insert -- is -- to “266”.

Column 12,
Lines 34-35, change “71 6” after -- 716 --.

Column 15,
Line 63, change “axis” to -- axle --.

Signed and Sealed this

Seventh Day of June, 2005

JON W. DUDAS
*Director of the United States Patent and Trademark Office*